US010870983B2

(12) United States Patent
Cervini

(10) Patent No.: US 10,870,983 B2
(45) Date of Patent: Dec. 22, 2020

(54) FOAM MEASURING AND INSULATING COVERS FOR WOOD AND STEEL FRAMING MEMBERS

(71) Applicant: Richard John Cervini, Mount Pleasant, SC (US)

(72) Inventor: Richard John Cervini, Mount Pleasant, SC (US)

( * ) Notice: Subject to any disclaimer, the term of this patent is extended or adjusted under 35 U.S.C. 154(b) by 0 days.

(21) Appl. No.: 16/687,591

(22) Filed: Nov. 18, 2019

(65) Prior Publication Data

US 2020/0157799 A1 May 21, 2020

Related U.S. Application Data

(60) Provisional application No. 62/769,032, filed on Nov. 19, 2018.

(51) Int. Cl.
*E04B 1/74* (2006.01)

(52) U.S. Cl.
CPC ..... *E04B 1/74* (2013.01); *E04B 2001/741* (2013.01); *E04B 2001/742* (2013.01)

(58) Field of Classification Search
CPC ..... E04B 1/74; E04B 2001/741; E04B 2001/742; E04B 2/7412; E04B 2001/7679; E04B 2002/567; E04B 2/707; E04C 3/29
See application file for complete search history.

(56) References Cited

U.S. PATENT DOCUMENTS

| | | | | |
|---|---|---|---|---|
| 3,531,901 | A * | 10/1970 | Will, Jr. | E04C 3/29 52/309.14 |
| 4,224,774 | A | 9/1980 | Petersen | |
| 4,257,204 | A | 3/1981 | Rieger | |
| 4,298,647 | A | 11/1981 | Cancio et al. | |
| 4,346,543 | A | 8/1982 | Wilson et al. | |
| 4,384,437 | A | 5/1983 | Coles | |
| 4,486,995 | A | 12/1984 | Allen et al. | |
| 4,586,308 | A | 5/1986 | Jennings | |
| 4,646,499 | A | 3/1987 | Wilson | |
| 4,709,523 | A | 12/1987 | Broderick et al. | |
| 4,747,246 | A | 5/1988 | Sanborn | |
| 4,835,026 | A | 5/1989 | Horiki et al. | |
| 4,866,905 | A | 9/1989 | Bihy et al. | |
| 5,003,742 | A | 4/1991 | Dettbarn | |

(Continued)

FOREIGN PATENT DOCUMENTS

GB 2501492 A * 10/2013 ..... E04F 13/141

*Primary Examiner* — Patrick J Maestri
(74) *Attorney, Agent, or Firm* — Kim and Lahey Law Firm, LLC; Seann P. Lahey

(57) ABSTRACT

An insulation cap for wall framing members comprising a base section; a first side wall extending outwardly from said base section; a second side wall laterally spaced from said first side wall and extending outwardly from said base section complementary to said first side wall; a generally U-shaped channel defined by said base section, said first side wall and said second side wall define for receiving a framing member so that at least a portion of an exterior surface of said framing member is encased by said base section, said first side wall and said second side wall; whereby a thermal break is provided between an exterior and interior sheathing around framing members and creates an airtight arrangement with insulation material for improved R values.

18 Claims, 18 Drawing Sheets

(56) References Cited

U.S. PATENT DOCUMENTS

| | | | | |
|---|---|---|---|---|
| 5,024,033 | A | 6/1991 | Anderson | |
| 5,099,629 | A | 3/1992 | Gay | |
| 5,209,036 | A | 5/1993 | Cancilliari | |
| 5,329,738 | A | 7/1994 | Ovaert et al. | |
| 6,125,608 | A | 10/2000 | Charlson | |
| 10,415,235 | B2 * | 9/2019 | Jie | E04B 1/10 |

* cited by examiner

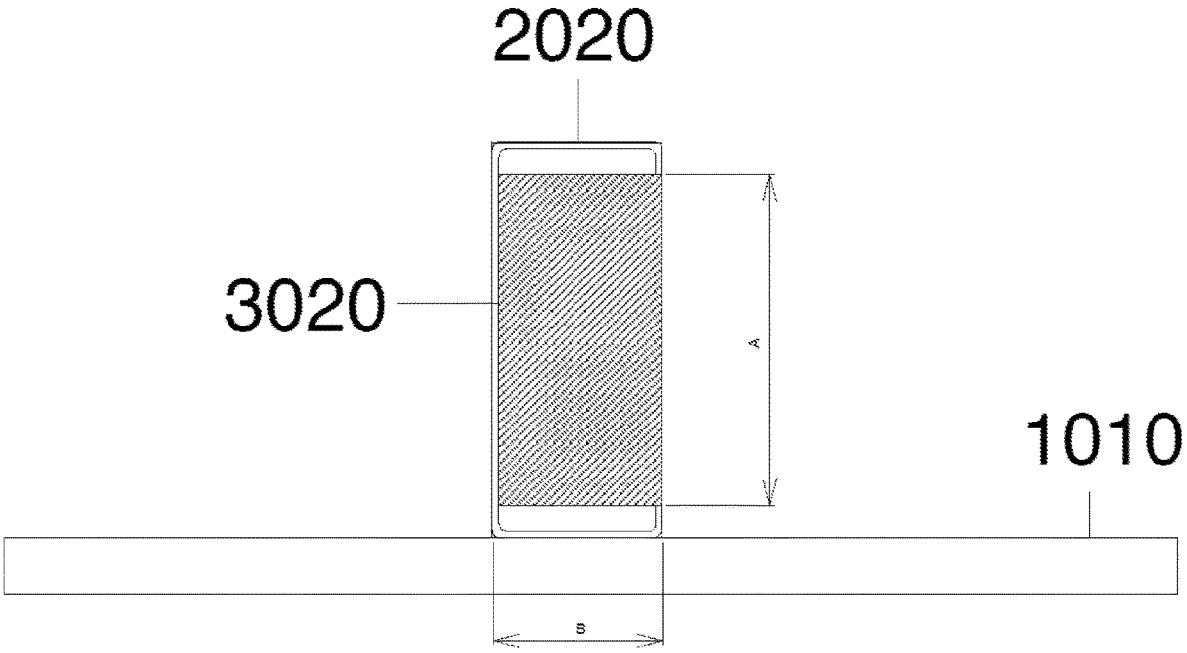
Figure 4.1

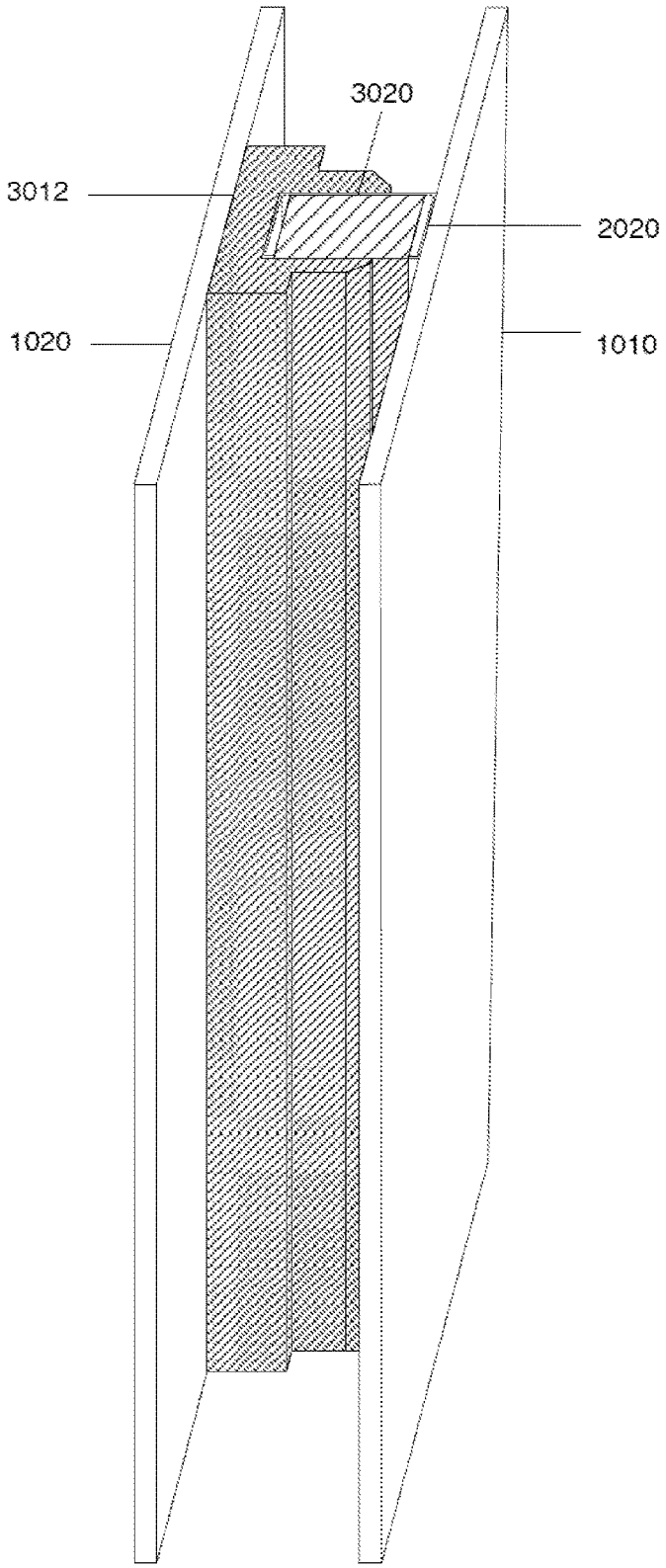
Figure 7.1

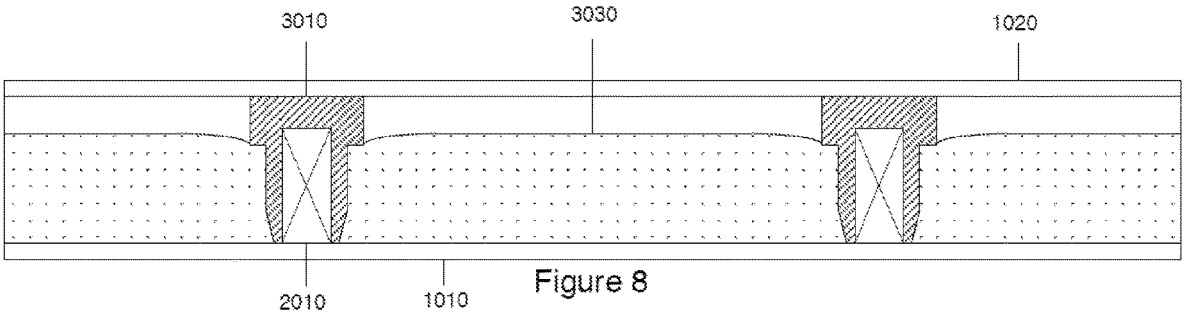
Figure 8
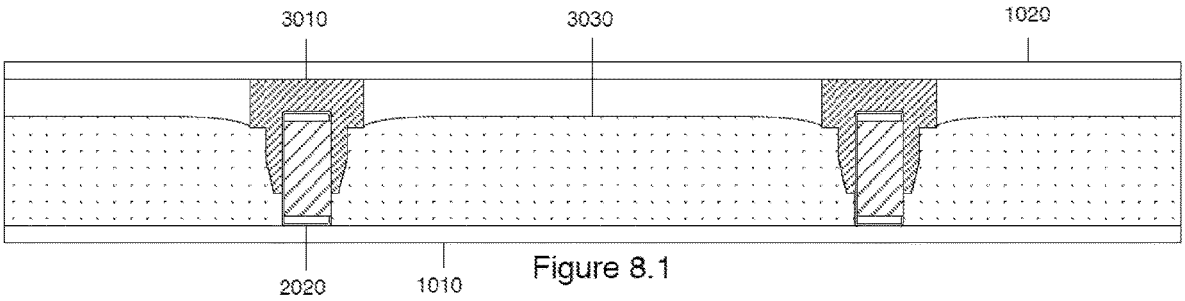
Figure 8.1
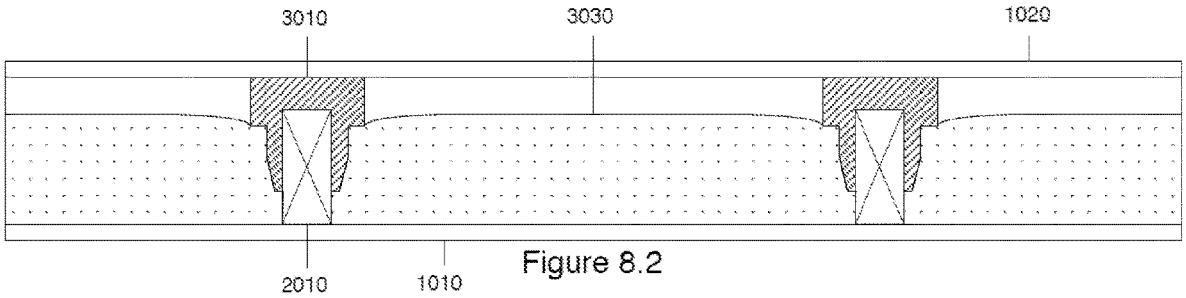
Figure 8.2

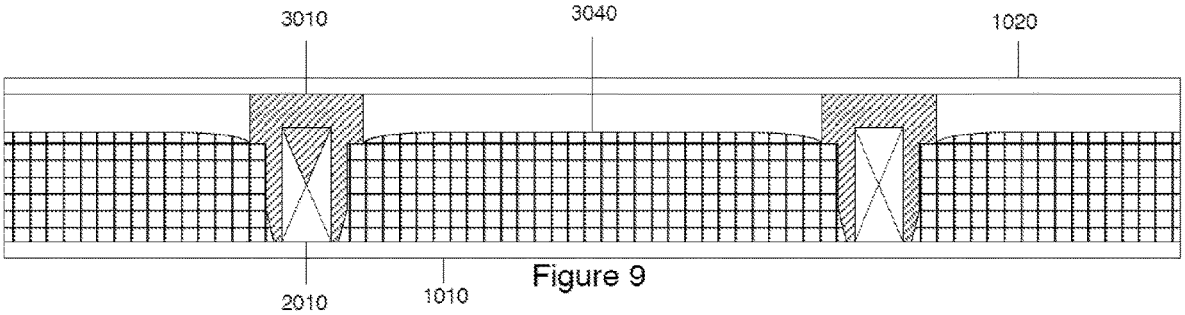
Figure 9
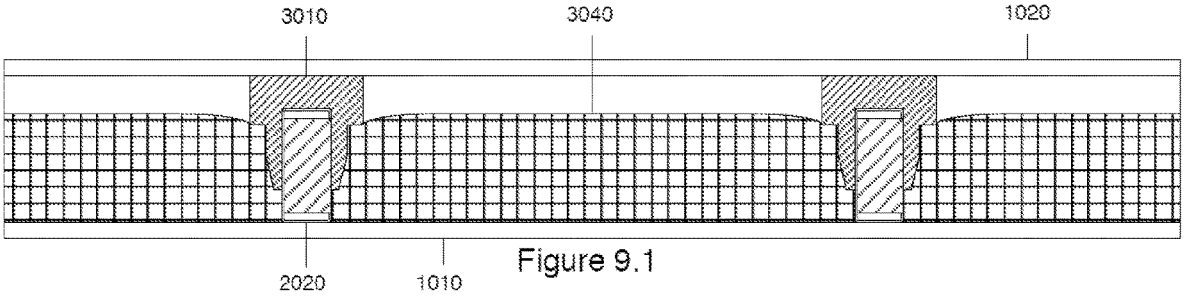
Figure 9.1
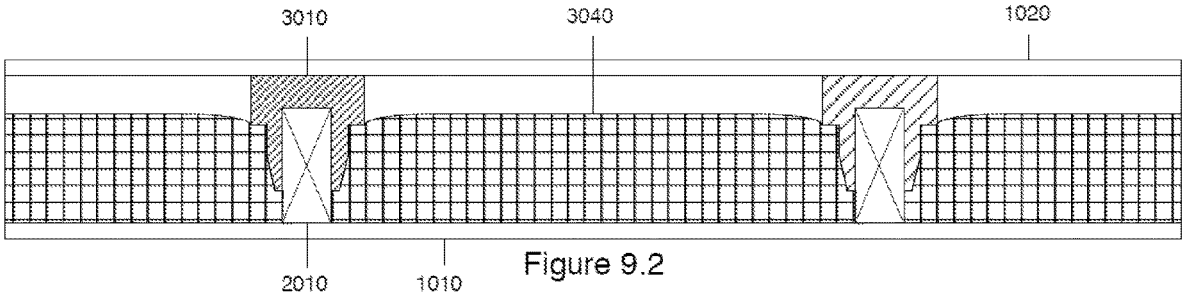
Figure 9.2

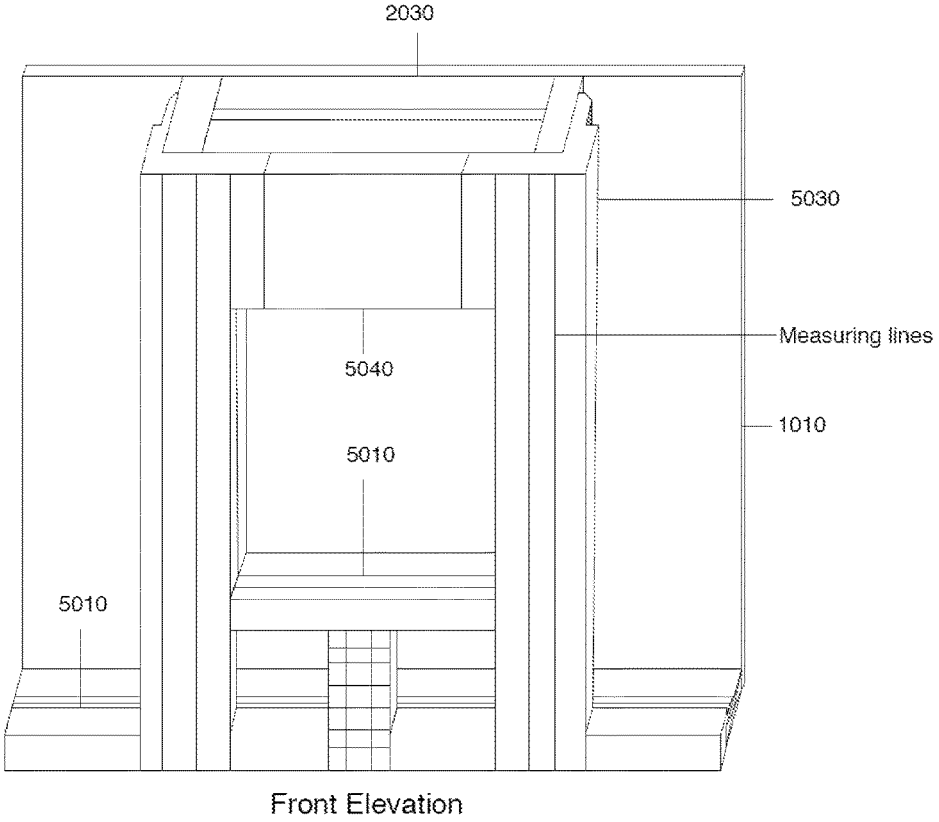
Figure 13
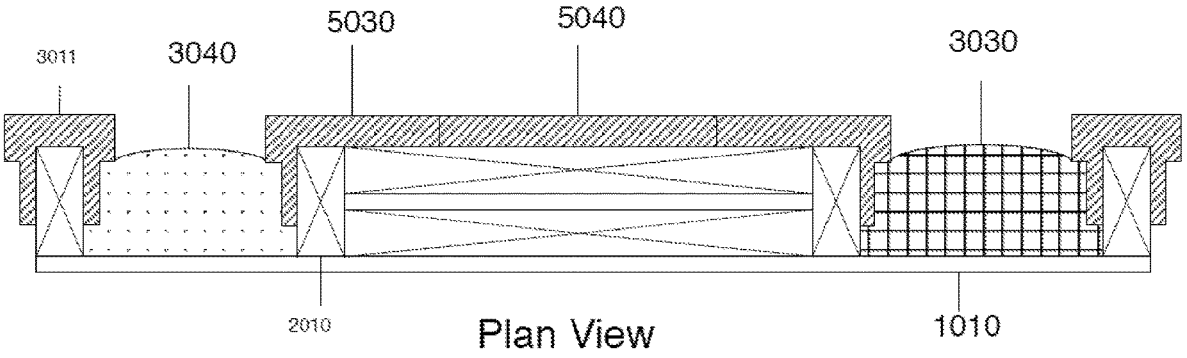
Figure 13.1

FOAM MEASURING AND INSULATING COVERS FOR WOOD AND STEEL FRAMING MEMBERS

BACKGROUND OF THE INVENTION

1) Field of the Invention

The present invention relates to the building industry for residential, commercial and industrial insulation purposes. More specifically, the disclosed invention, relates to insulation applications involving polyurethane foam and fiberglass insulation application around framing members. It also includes a measuring capability that can increase the accuracy and decrease waste of the tradesman on the project the invention will be used on.

2) Description of Related Art

The prior art, generally, is related to spray polyurethane foam and fiberglass insulation used to insulate the inner walls between the studs. However, such insulation is not intended to insulate the framing members themselves. Typically, a large sheet of foam board is nailed or screwed to the front of the framing members for insulation, which does not fully cover the framing members and wastes material. Further, the nails and screws in the front of the framing members allow for heat transfer through the insulation that reduces the overall R rating.

Thermal bridging through structural framing members can be a major source of heat loss throughout the building envelope. There is a need to improve thermal performance in buildings in order to conserve energy to protect our natural resources.

There are two basic methods, a building that is framed with traditional 2×4 studs, and or other dimensional lumber, needs to be covered with continuous rigid insulation on the exterior of the building. This comes as a rather high economic and environmental cost.

Another method for enhancing building thermal insulation is by using deeper than necessary framing studs. This creates deeper cavities to accommodate more insulation.

Most two-story buildings need only 2×4 framing material to meet all structural loads. By increasing it to 2×6 to gain the cavity depth increases cost and unnecessary depletion of natural resources.

Accordingly, it is an object of the present invention to provide insulation specific to covering framing members of a wall that is secured to the interior facing sides of the framing members to improve insulation ratings.

It is a further object of the present invention to provide insulation caps for mounting to framing members that include measurement markings to improve installation and reduce waste.

SUMMARY OF THE INVENTION

The above objectives are accomplished according to the present invention by providing an insulation system for wall framing member, comprising a wall structure having a plurality of framing members with an exterior sheathing disposed on an exterior facing side and an interior sheathing disposed on an interior facing side; an insulation cap carried by at least one of said framing members; said insulation cap including a base section with a first side wall extending outwardly from said base section, and a second side wall laterally spaced from said first side wall and extending outwardly from said base section complementary to said first side wall, wherein said base section, said first side wall and said second side wall define a generally U-shaped channel, and wherein said at least one framing member is received into said U-shaped channel so that at least a majority of an exterior surface of said at least one framing member is encased by said insulation cap; a first shoulder portion disposed on a first end portion of said base section, and a second shoulder portion dispose on a second end portion of said base section opposite said first shoulder portion, wherein said first shoulder portion extends laterally outward perpendicular to said first side wall so that said first side wall and said first shoulder portion define a first retention ledge, and wherein said second shoulder portion extends laterally outward perpendicular to said second side wall so that said second side wall and said second shoulder portion define a second retention ledge; and, an insulation material disposed between said framing members, wherein said insulation material engages and is at least partially retained between said framing members by at least one of said first and second retention ledges; whereby said insulation cap provides a thermal break between said exterior sheathing and said interior sheathing around said framing members and provides an airtight arrangement with said insulation material between said framing members for improved R values.

In a further advantageous embodiment, said insulation cap includes measurement markings on said base section defining a graduated scale to facilitate installation.

In a further advantageous embodiment, said insulation cap includes securing member markings on said first and second side walls indicating preferred locations for inserting a securing member through said first and second side walls, respectively, to secure said insulation cap to an interior facing side surface of said at least one framing member.

In a further advantageous embodiment, said insulation material is selected from the group consisting of fiberglass batt insulation and spray foam insulation.

In a further advantageous embodiment, said retention ledge operates as a depth gauge when said insulation material is spray foam insulation.

In a further advantageous embodiment, said insulation cap is carried on adjacent framing members with a fiberglass batt insulation disposed between framing members engaging said first retention ledges on a first said insulation cap and engaging said second retention ledge on a second insulation cap of the adjacent framing member for securing said fiberglass batt between said framing members.

In a further advantageous embodiment, said first and second side walls of said insulation cap extend along the length of an interior facing side surface of said at least one framing member and abut said exterior sheathing so that said insulation cap fully encases three sides of said framing member.

In a further advantageous embodiment, said first and second side walls of said insulation cap extend along a majority of the length of an interior facing side surface of said at least one framing member and define an expansion gap between a distal end of said first and second side walls and said exterior sheathing along the remainder of said interior facing side surface for accommodating expansion of said insulation material.

In a further advantageous embodiment, said first and second side walls include a tapered end portion providing a recess area for accommodating expansion of said insulation material.

In a further advantageous embodiment, said insulation cap is comprised of about 2 to about 10 pound poured polyurethane foam and provides structural support to said wall structure.

In a further advantageous embodiment, said framing members comprise metal studs having a generally C-shaped channel shaped carrying an insulation block in said C-shaped channel, and wherein at least one of said first and second side walls of said insulation cap extend adjacent said insulation block to secure said insulation block in said C-shaped channel.

In a further advantageous embodiment, said first and second shoulder portions extend at right angles to said first side wall and second side wall, respectively, to define said retention ledges.

In a further advantageous embodiment, said U-shaped channel of said insulation cap is defined in part by a recess into said base section between said first side wall and said second side wall relative to said first and second retention ledges so that a front surface of said at least one framing member is received into said recess in said base section.

In a further advantageous embodiment, a first insulation cap is disposed on said framing member between said interior sheathing and said framing member, and a second insulation cap is disposed on said framing member between said exterior sheathing and said framing member opposite said first insulation cap.

The above objectives are further accomplished according to the present invention by providing an insulation cap for wall framing members, comprising: a base section; a first side wall extending outwardly from said base section; a second side wall laterally spaced from said first side wall and extending outwardly from said base section complementary to said first side wall; a generally U-shaped channel defined by said base section, said first side wall and said second side wall define for receiving a framing member so that at least a portion of an exterior surface of said framing member is encased by said base section, said first side wall and said second side wall; a first shoulder portion disposed on a first end portion of said base section; a second shoulder portion dispose on a second end portion of said base section opposite said first shoulder portion; wherein said first shoulder portion extends laterally outward perpendicular to said first side wall so that said first side wall and said first shoulder portion define a first retention ledge; wherein said second shoulder portion extends laterally outward perpendicular to said second side wall so that said second side wall and said second shoulder portion define a second retention ledge; and, wherein said U-shaped channel is recess into said base section between said first side wall and said second side wall relative to said first and second retention ledges so that a front surface of the framing member is received into said recess in said base section.

In a further advantageous embodiment, measurement markings are included on said base section defining a graduated scale to facilitate installation.

In a further advantageous embodiment, securing member markings are included on said first and second side walls indicating preferred locations for inserting a securing member through said first and second side walls, respectively, to secure said insulation cap to an interior facing side surface of the framing member.

In a further advantageous embodiment, said first and second side walls include a tapered end portion providing a recess area for accommodating expansion of said insulation material.

In a further advantageous embodiment, said first and second side walls of said insulation cap are constructed and arranged to extend along a majority of the length of an interior facing side surface of the framing member and define an expansion gap along the remainder of said interior facing side surface between a distal end of said first and second side walls and an exterior sheathing mounted to the framing member for accommodating expansion of insulation material disposed between framing members.

The above objectives are further accomplished according to the present invention by providing an insulation cap for wall framing members, comprising: a base section; a first side wall extending outwardly from said base section; a second side wall laterally spaced from said first side wall and extending outwardly from said base section complementary to said first side wall; a generally U-shaped channel defined by said base section, said first side wall and said second side wall define for receiving a framing member so that at least a majority of an exterior surface of said framing member is encased by said base section, said first side wall and said second side wall; a tapered end portion included on each of said first and second side walls defining a recess area for accommodating expansion of insulation material; measurement markings included on said base section defining a graduated scale along an entire length of said base section; a first shoulder portion disposed on a first end portion of said base section; a second shoulder portion dispose on a second end portion of said base section opposite said first shoulder portion; wherein said first shoulder portion extends laterally outward perpendicular to said first side wall so that said first side wall and said first shoulder portion define a first retention ledge; wherein said second shoulder portion extends laterally outward perpendicular to said second side wall so that said second side wall and said second shoulder portion define a second retention ledge; and, wherein said U-shaped channel is recess into said base section between said first side wall and said second side wall relative to said first and second retention ledges so that a front surface of the framing member is received into said recess in said base section.

BRIEF DESCRIPTION OF THE DRAWINGS

The system designed to carry out the invention will hereinafter be described, together with other features thereof. The invention will be more readily understood from a reading of the following specification and by reference to the accompanying drawings forming a part thereof, wherein an example of the invention is shown and wherein:

FIG. 4.1 shows a top cross-section view of an insulated filler in a C-channel framing member according to the present invention;

FIG. 7.1 shows a perspective view of a wall section depicting the application of interior and exterior sheathing on opposite sides of the framing member and insulation cap according to the present invention;

FIGS. 8, 8.1 and 8.2 shows a top cross-section view of an insulated wall cavity utilizing spray polyurethane foam insulation between and around portion of the insulation cap on the framing members according to the present invention;

FIGS. 9, 9.1 and 9.2 shows a top cross-section view of an insulated wall cavity utilizing fiberglass batt insulation between and around portion of the insulation cap on the framing members according to the present invention;

FIG. 13 shows a front elevation perspective view of an insulated wood framed wall with the insulation caps covering frame members according to the present invention;

FIG. 13.1 shows a top plan cross-section view of an insulated wood framed wall with the insulation caps covering frame members according to the present invention;

Figure 1:
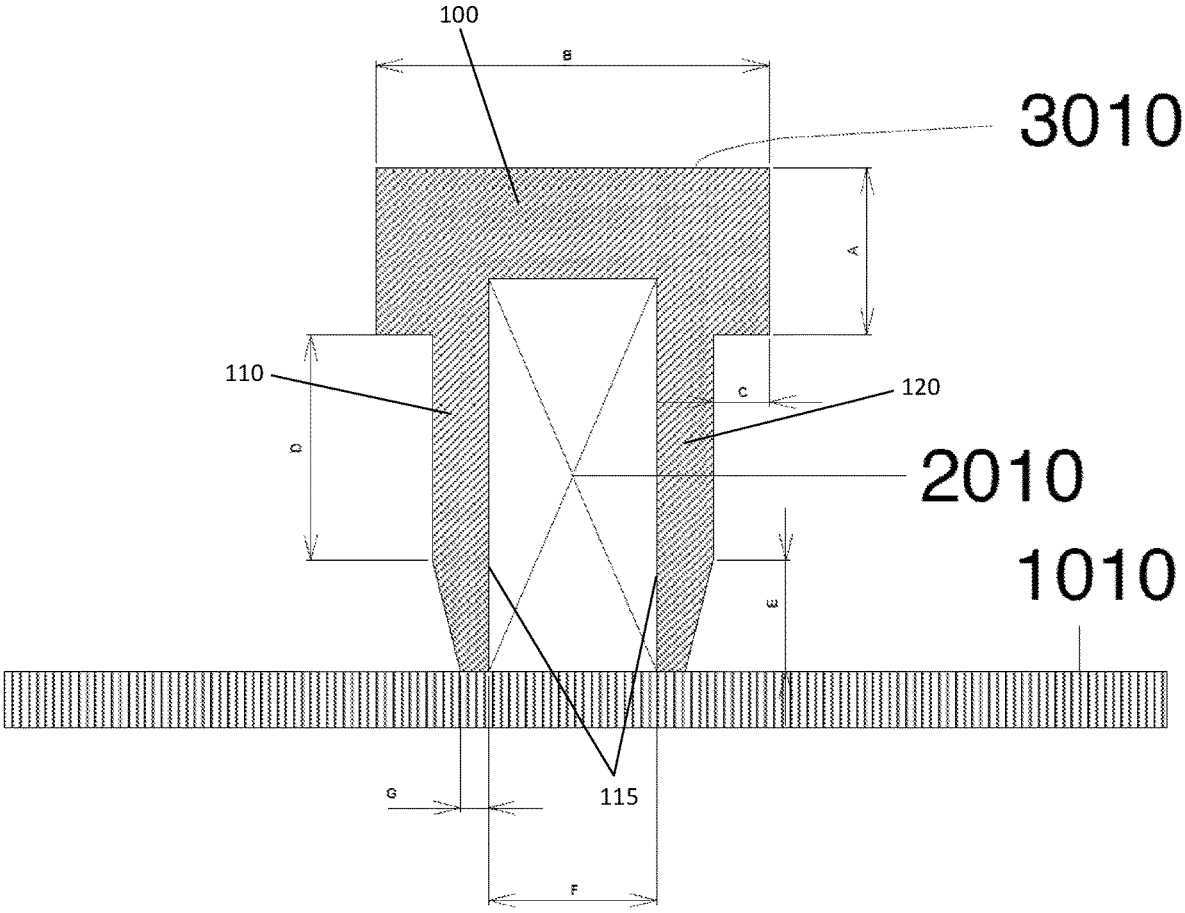
FIG. 1 shows a top cross-section view of an insulation cap over wooden framing members according to the present invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The disclosed invention provides methods and materials effective in reducing energy transfer through metal or wood framing members in residential, commercial and industrial building structures and increasing the accuracy of other tradesmen involved with the project by utilizing a measuring function built into the insulation caps of the present invention. The invention works by utilizing an insulation cap that insulates the structural and non-structural members of exterior walls and roof systems. Utilizing the insulation caps, an airtight envelope can be created which slows the transfer of energy through the wall structure for improved R values.

Figure 3:
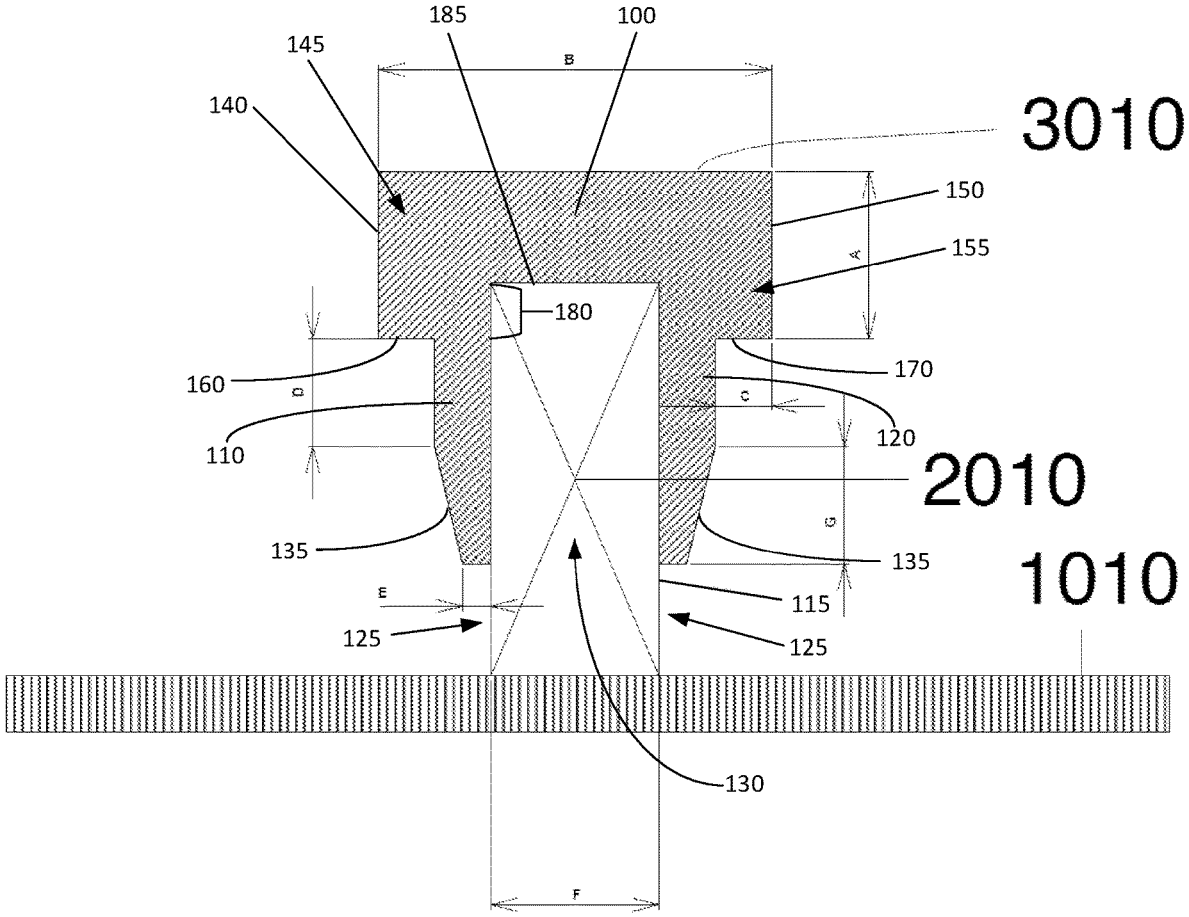
FIG. 3 shows a top cross-section view of an insulation cap over wooden framing members according to the present invention.

According to the present invention, the external structural wall and nonstructural wall framing members such as a wooden wall stud, rafters, floor joists, and metal C-shaped studs are covered with a polyurethane foam insulation cap nailed to the interior facing sides of the framing member. By securing the insulation caps to the interior facing sides of the framing members any energy transfer from the framing member to the nail or screw is directed into the insulation between framing members and not directed through the exterior or interior sheathing of the wall. The insulation caps may be arranged such that the insulation cap covers the framing member and is in contact with the external surface of the wall structure, such as shown in FIG. 1, or may provide an expansion gap as shown in FIG. 3. The insulation cap provides a thermal break between external structural supports in the structure supported thereby, such as plywood sheathing, composite sheathing, and the interior wall board. In a typical embodiment, the insulation cap has a lower thermal conductivity then the framing member. Further, the insulation caps become part of the structure of the building.

The insulation caps are constructed and arranged to have a friction fit arrangement with the framing members to hold the insulation cap in place. However, in order to further secure and maintain contact between the framing member and the insulation caps according to the present invention during installation, there are a few techniques that may be employed, alone or in combination. The invention can be attached with an adhesive bonding agent, nails, staples, screws, clips, button caps, and the like. Mechanical fastening is preferred when the insulation cap is to be used in conjunction with spray polyurethane foam to avoid dislodging the insulation caps from the framing members.

According to the invention, the insulation caps are preferably manufactured from about 2 to about 10 pound poured polyurethane foam, which is fabricated in molds to achieve a functional shape as shown in the illustrations of the insulation caps.

This material may be used in a variety of configurations to suit different construction details. In general, the insulation cap has a generally U-shaped cross-section such that at least a portion of which is adapted to contact a portion of the external surface of a framing member. The insulation caps further includes measurement markings defining a graduated scale. The insulation caps are manufactured of material density and configurations to withstand anticipated compressive loading, with no margin, so as to the function properly as a structural feature of the building, as well as a thermal insulator and measuring device. Further, the insulation caps may include one or more laterally extending shoulders which partially bridge between wall stud cavities, cathedral ceiling rafter cavities, floor joist cavities, ceiling cavities to facilitate installation and retention of nonrigid insulation such as fiberglass batts.

When C-shaped metal studs are used, a flexible or rigid insulator filling the cavity of the metal stud may be used. Then either sprayed polyurethane foam or fiberglass batts maybe used to fill the cavity to a desired thickness. Wallboard for a desired sheathing may then be applied.

Figure 10:
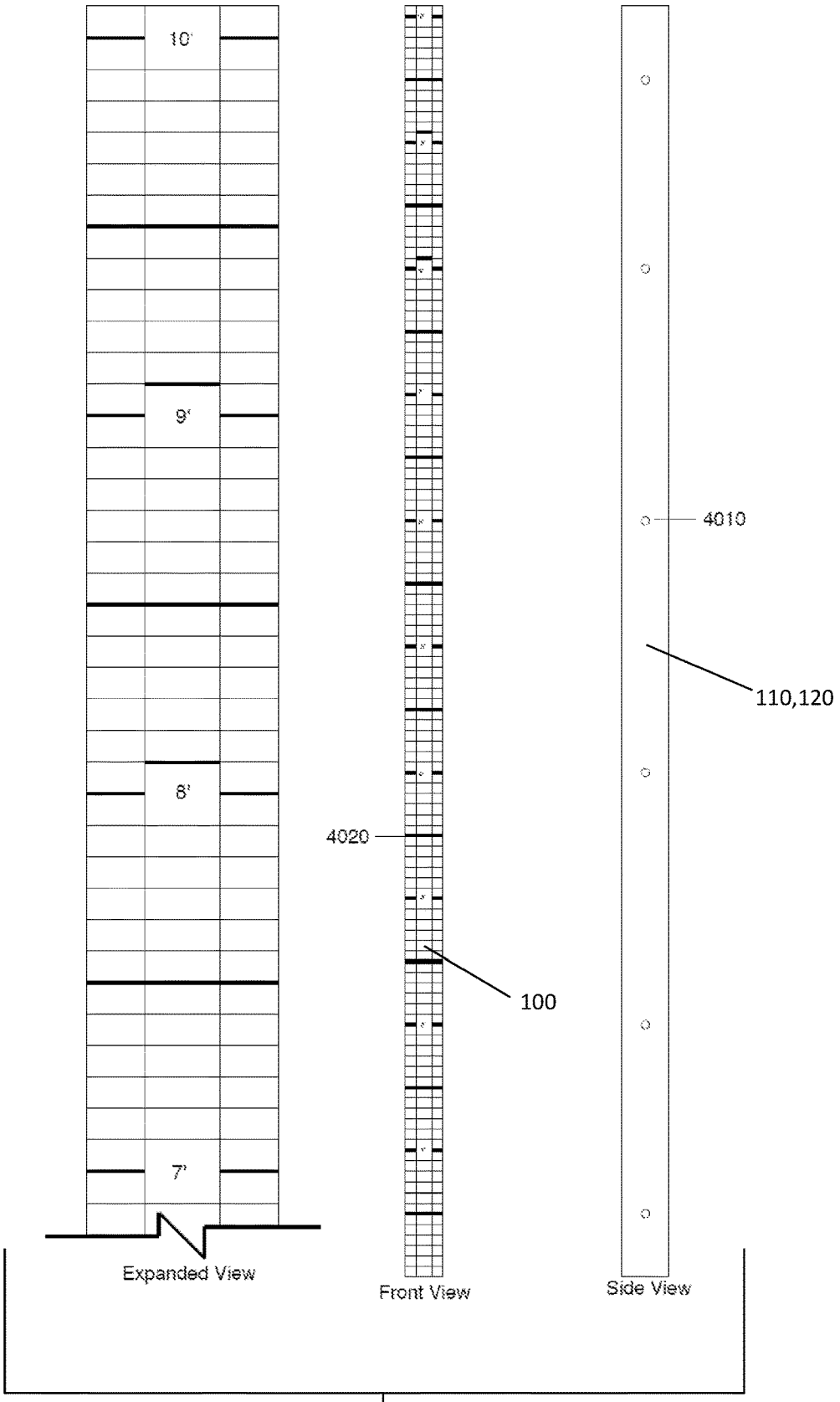
FIG. 10 shows an elevation view of an insulation cap having measurement markings according to the present invention.
Figure 14:
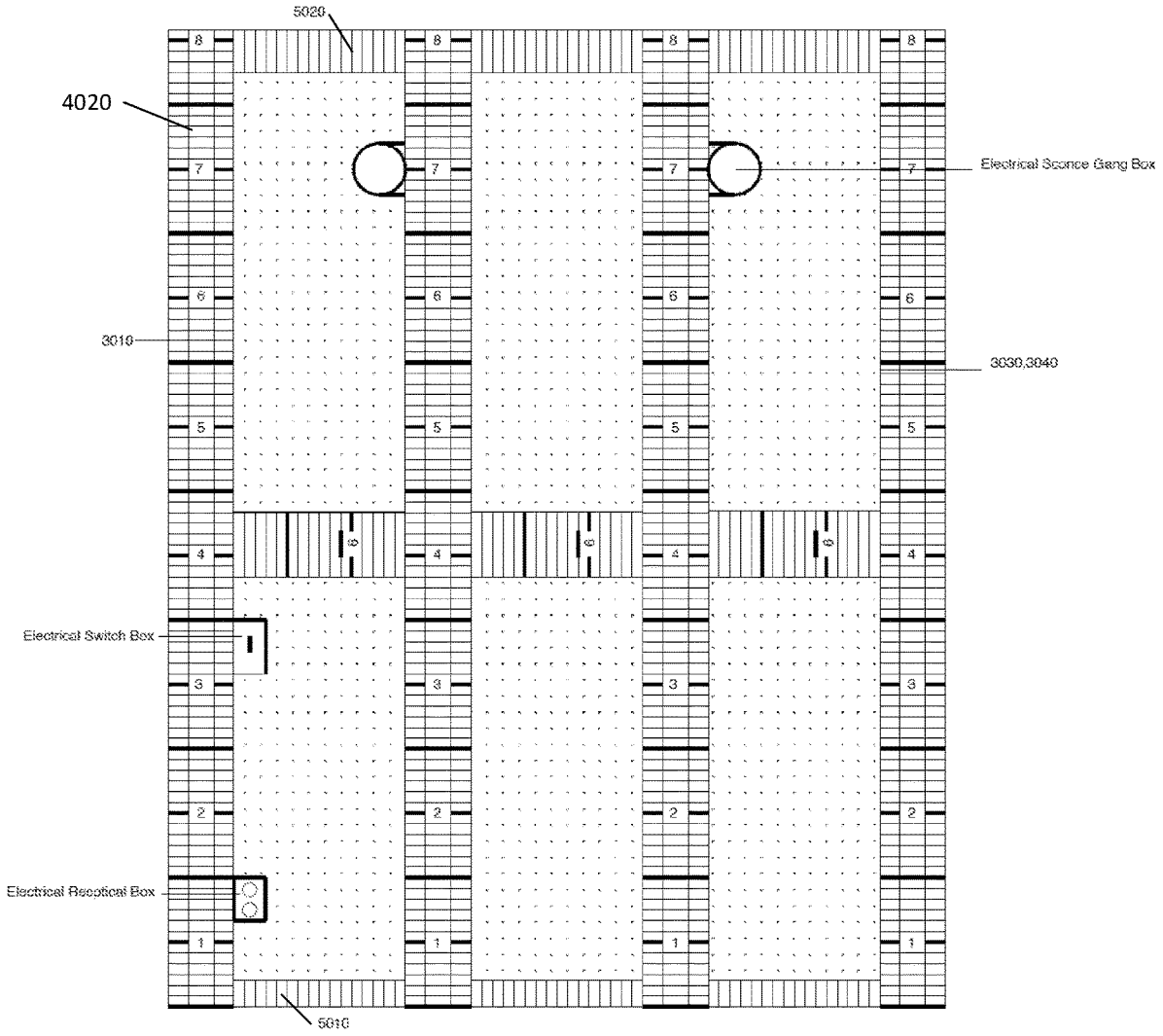
FIG. 14 shows an elevation view of an insulated wall having insulation caps with measurement markings covering framing members according to the present invention.

Referring to FIGS. 10 and 14, the embedded measurement marking system will then be used by many of the tradesmen during their installation processes. The measuring system will increase accuracy, installation time and reduce waste of all tradesmen, thus increasing profitability and saving resources.

This invention is specifically designed to decrease the transfer of energy in any building structure. While also providing a visual site gauge to increase accuracy of tradesman performing work such as drywall installation, electrical installation, plumbing installation, and HVAC installation. These are just a few of the trades that will benefit from this invention. The disclosed invention can be installed from either the exterior or interior of the building envelope. It is designed more specifically to work with spray foam and fiberglass batt insulation materials.

The insulation caps detailed herein provide a technology in the building construction system that allows rigid insulation materials to be is optimally placed along framing members of a building to provide thermal and acoustical insulation as well as a visual site gauge for installation of additional building products. The system can also be used as advantageously to resist hurricane forces, wind uplift forces, lateral sheer forces, as well as other dynamic and static impressive loads in structural roofing applications.

Figure 2:
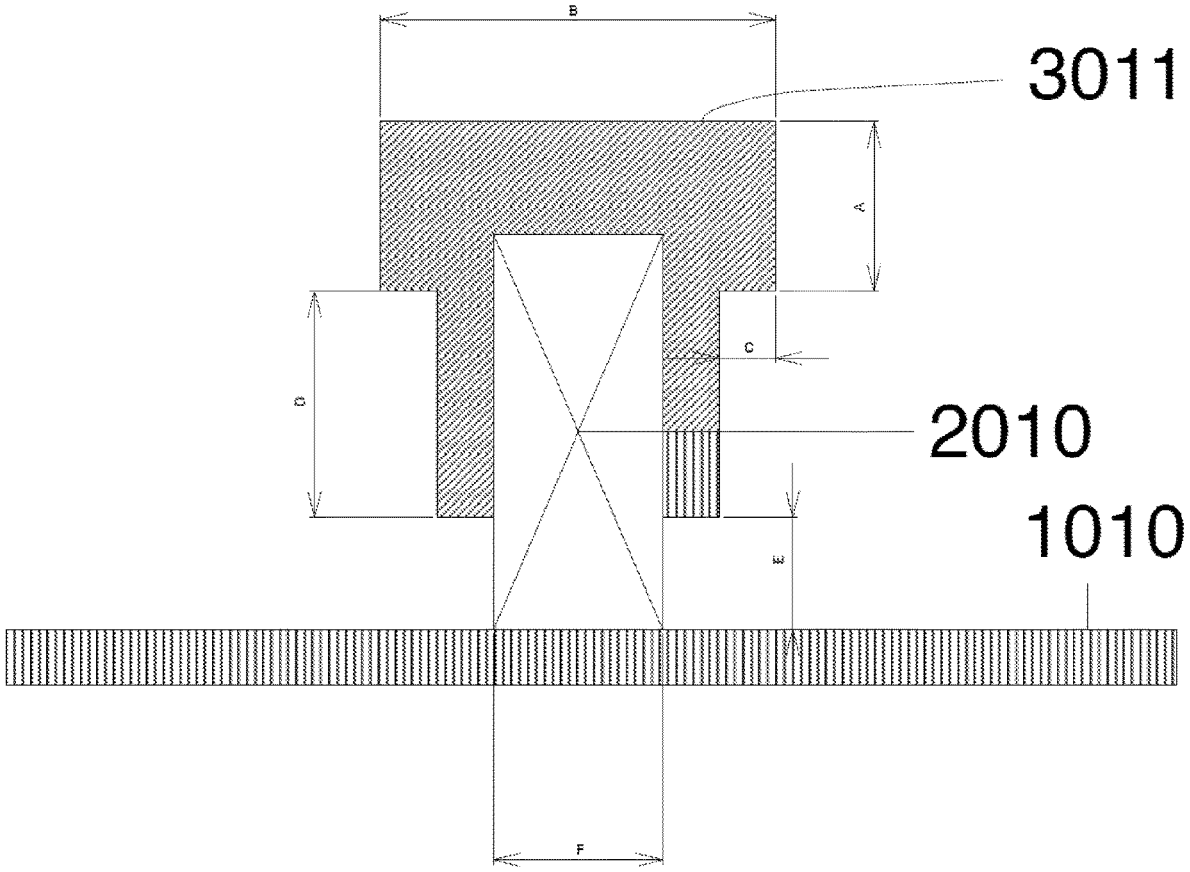
FIG. 2 shows a top cross-section view of an insulation cap over wooden framing members according to the present invention.

Referring to FIGS. 1-3, a polyurethane foam measurement insulating cover 3010 or "insulation cap" is shown being used over a framing member 2010. This profile can be installed using standard roofing nails, staples and lath screws. This invention is preferably mechanically fastened in order to withstand the lateral pressures utilizing polyurethane spray foam.

Referring to FIG. 3, insulation cap 3010 includes a base section, designed generally as 100, with a first side wall 110 extending outwardly from base section 100, and a second side wall 120 laterally spaced from first side wall 110 and extending outwardly from base section 100 complementary to first side wall 110. Base section 100, first side wall 110 and second side wall 120 define a generally U-shaped channel 130. Framing member 2010 is received into U-shaped channel 130 in a friction fit arrangement so that at least a majority of an exterior surface of the framing member is encased by the insulation cap 3010. In the illustrated embodiments, U-shaped channel 130 is defined in part by a recess 180 into base section 100 between first side wall 110 and second side wall 120 relative to first and second retention ledges 160, 170 so that a front surface 185 of the framing member 2010 is received into recess 180.

In the illustrated embodiments and with further reference to FIG. 3, a first shoulder portion 140 is disposed on a first end portion, designed generally as 145, of base section 100. A second shoulder portion 150 is dispose on a second end portion 155 of base section 100 opposite first shoulder portion 140. First shoulder portion 140 extends laterally outward perpendicular to first side wall 110 so that first side wall 110 and first shoulder portion 140 define a first retention ledge 160, and second shoulder portion 150 extends laterally outward perpendicular to second side wall 120 so that second side wall 120 and second shoulder portion 150 define a second retention ledge 170. Referring to FIGS. 8, 8.1, 8.2 and 9, 9.1 and 9.2, an insulation material, such as spray foam 3030 or fiberglass batt 3040, is disposed between framing members 2010, 2020, such that the insulation material engages and is at least partially retained between the framing members by first and second retention ledges 160, 170. Further, retention ledges 160, 170 also operate as a depth gauge when the insulation material is spray foam insulation. In the illustrated embodiment, first and second shoulder portions 140, 150 extend at right angles to first side wall 110 and second side wall 120, respectively, to define retention ledges 160, 170.

Accordingly, insulation cap 3010 provides a thermal break between exterior sheathing 1010 and said interior sheathing 1020 around framing members 2010, 2020 and provides an airtight arrangement with the insulation material 3030, 3040 between the framing members for improved R values.

Referring to FIG. 1, in the illustrated embodiment, first and second side walls 110, 120 of insulation cap 3010 extend along the length of an interior facing side surface 115 of said framing member 2010 and abut exterior sheathing 1010 so that said insulation cap fully encases three sides of the framing member.

Referring to FIG. 3, in the illustrated embodiment, first and second side walls 110, 120 of insulation cap 3010 extend along a majority of the length of an interior facing side surface 115, but not the entire length, of the framing member 2010 to define an expansion gap 125 between a distal end of first and second side walls 110, 120 and exterior sheathing 1010 along the remainder of interior facing side surface 115 for accommodating expansion of insulation material 3030, 3040 (see also FIGS. 8.1 and 9.1).

Further, in the illustrated embodiments of FIGS. 1 and 3, first and second side walls 110 and 120 include a tapered end portion 135 providing a recess area for accommodating expansion of insulation material 9 (see also FIGS. 8, 8.1, 8.2, 9, 9.1, 9.2, and 13.1).

Figure 4:
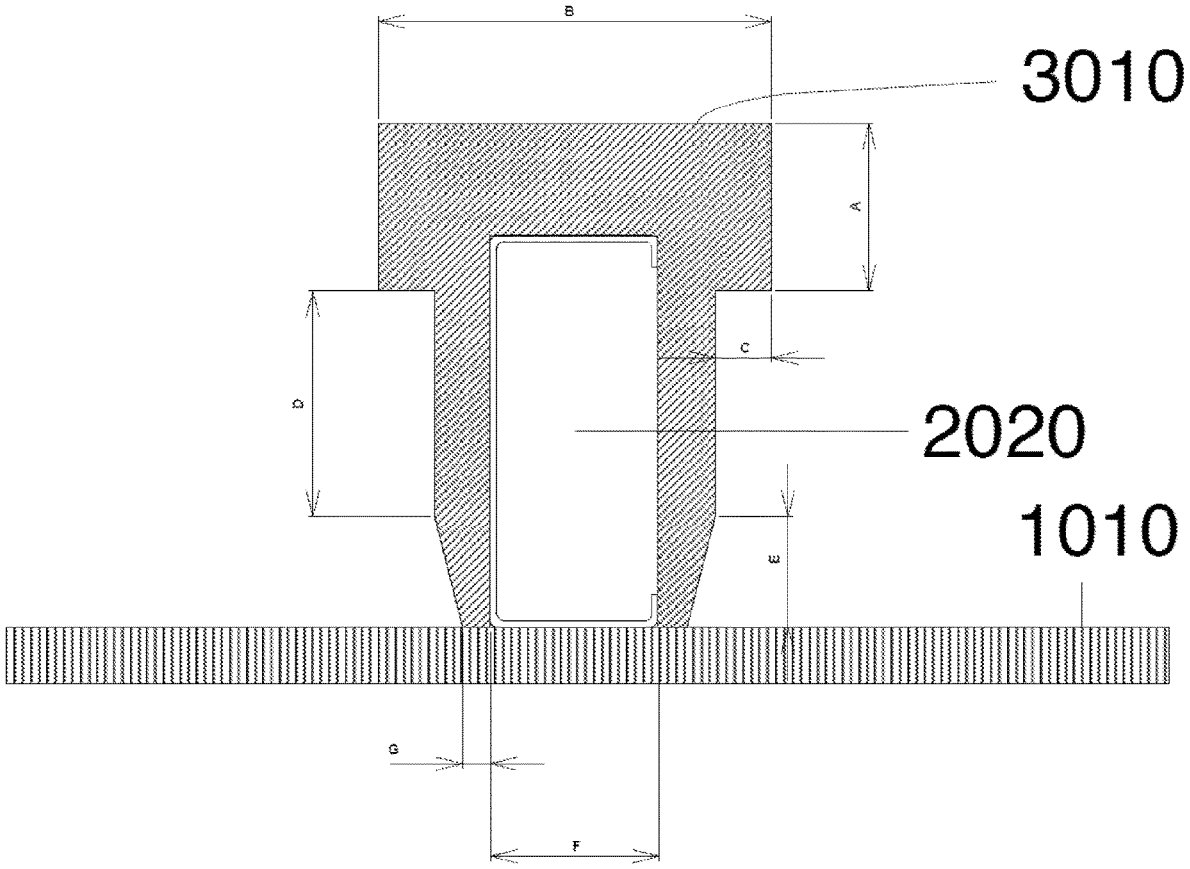
FIG. 4 shows a top cross-section view of an insulation cap over steel framing members according to the present invention.

FIG. 4 refers to insulation cap 3010 as illustrated being used over a C-channel metal framing member 2020. Insulation cap 3010 is preferably installed with wide head screws such as lath screws or equivalent. The screws may be installed on the inside or face of the wall cavity section of insulation cap 3010. The "C dimension in which shoulders extend laterally outward past the side wall define a retaining ledge for fiberglass insulation, as well as a depth gauge for spray polyurethane foam insulation which as shown in FIGS. 8, 8.1 and 8.2 should extend generally to the bottom of the retaining ledge. Dimension E is at a slight angle defining a tapered end portion to allow for material expansion in order to increase frictional retention of the fiberglass insulation as well as eliminate all air voids in insulated areas.

Figure 5:
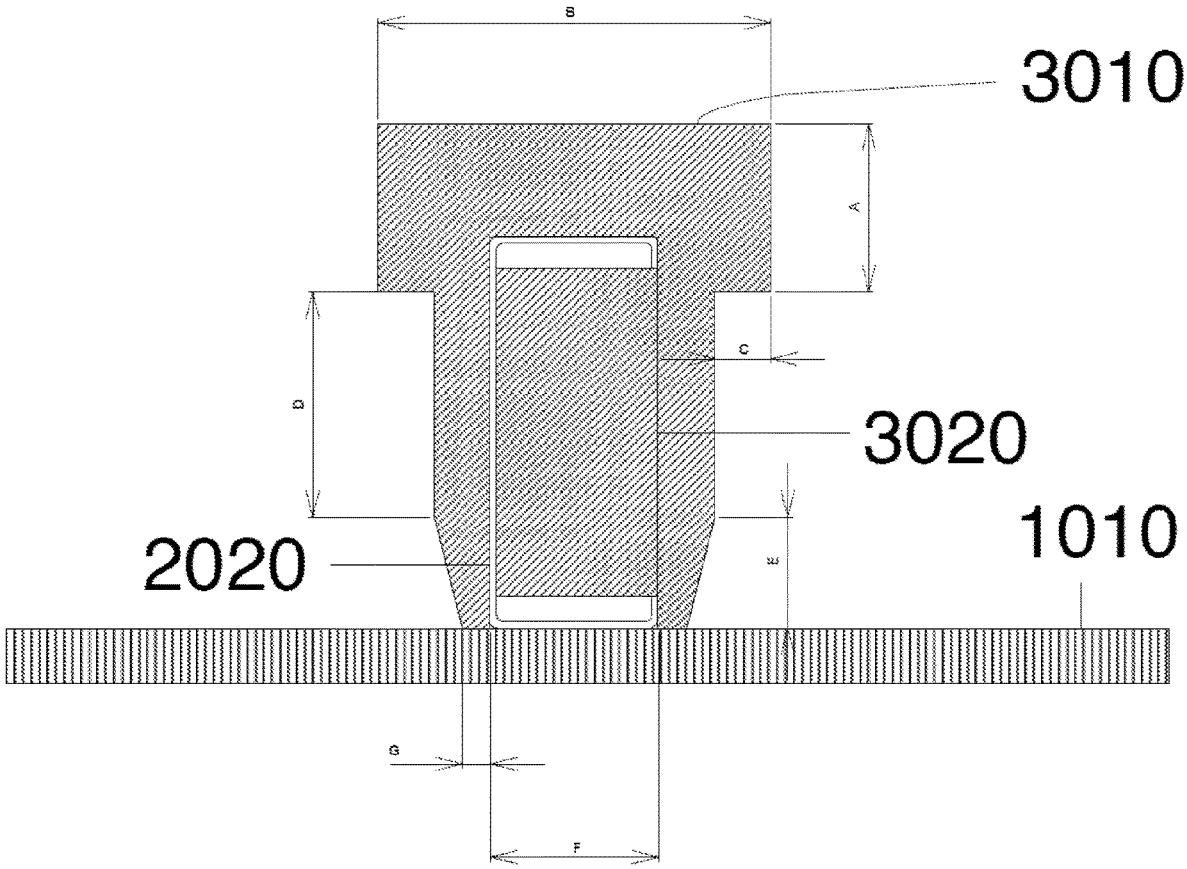
FIG. 5 shows a top cross-section view of an insulation cap over an insulated filler in a C-channel framing member according to the present invention.
Figure 6:
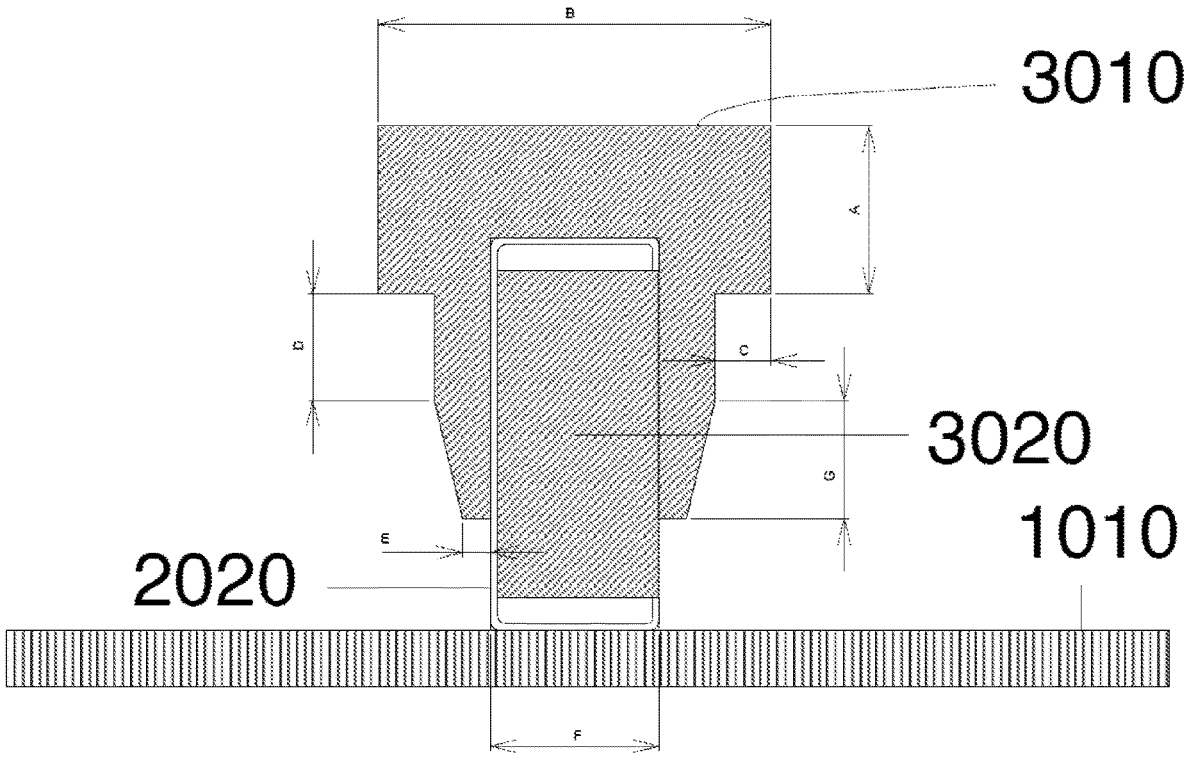
FIG. 6 shows a top cross-section view of an insulation cap over an insulated filler in a C-channel framing member according to the present invention.

Referring to FIGS. 4 and 4.1, the framing member 2020 comprise metal studs having a generally C-shaped channel shaped carrying an insulation block 3020 in the C-shaped channel. The "A" dimension should be determined at the inside dimension of the C-shaped channel to insure a tight fit. Foam filler insulation block 3020 should run the entire length of the cavity of framing member 2020. As best shown in FIGS. 5 and 6, insulation block 3020 is further held in place by friction and the side walls 110, 120 of the insulation cap 3010, which extend adjacent to the insulation block to secure it in the channel.

Figure 7:
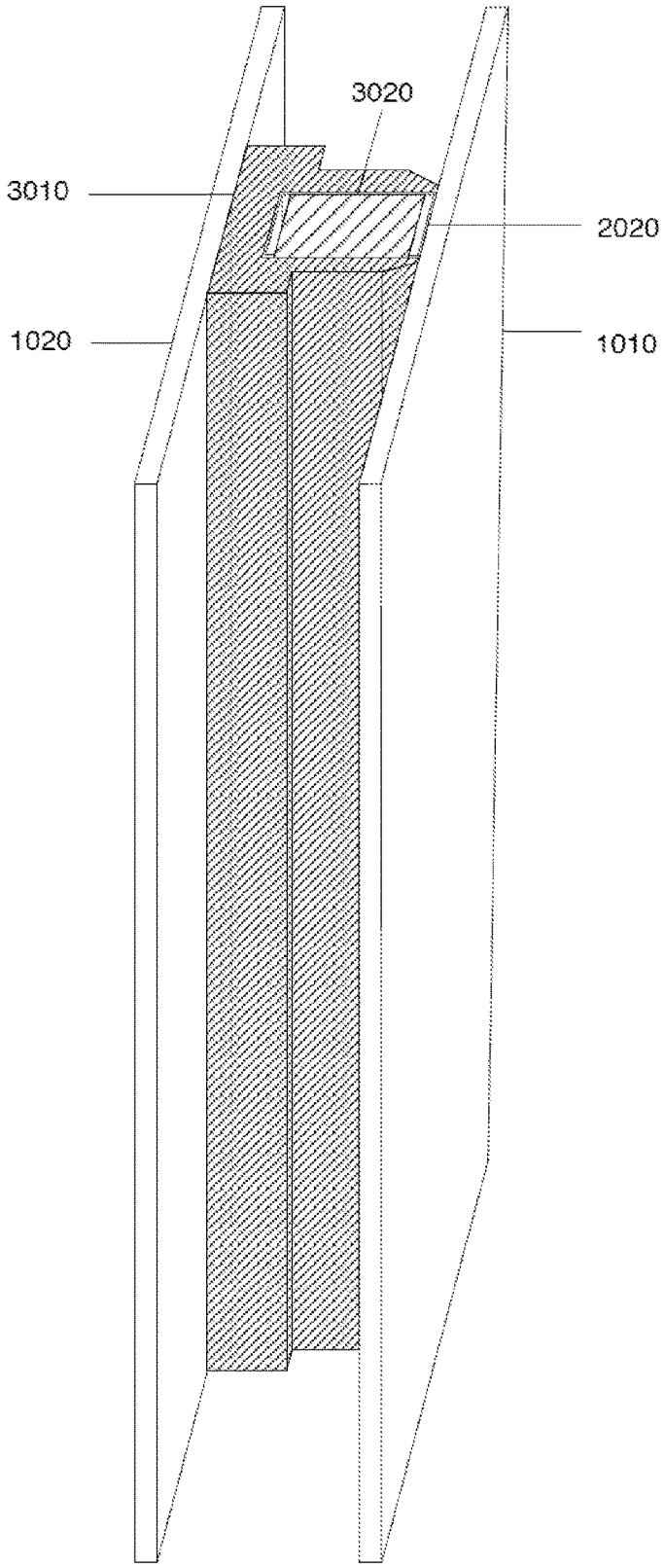
FIG. 7 shows a perspective view of a wall section depicting the application of interior and exterior sheathing on opposite sides of the framing member and insulation cap according to the present invention.

FIGS. 7 and 7.1 represents an exterior wall section with a C-shaped stud 2020. This wall section is furnished with a foam filler insulation block 3020 and an insulation cap 3010. The insulation cap is encased between a 1010 exterior sheathing member, such as a plywood member, and a 1020 interior sheathing member, such as a drywall member.

FIGS. 8-9.2 and 13.1 represent plan views of how the invention performs in a stud or C-channel stud wall 2010, 2020. By utilizing the shape of the insulation cap 3010 minimal air gaps are created which greatly decreases thermal transfer.

FIGS. 10 and 14 show the measurement portion of the invention in the insulation caps. In the illustrated embodiment, insulation cap 3010 includes measurement markings 4020 on base section 100 defining a graduated scale to facilitate installation. In a further advantageous embodiment, insulation cap 3010 includes securing member markings 4010 on first and second side walls 110, 120 indicating preferred locations for inserting a securing member through the first and second side walls, respectively, to secure the insulation cap to an interior facing side surface 1115 (FIG. 3) of the framing member 2010, 2020. The measurement markings 4020 are done to scale and are to help all tradesmen on the job with their prospective tasks. As shown in FIG. 14, the measurement markings 4020 provides a built-in visual line for easily locating and installing supplemental wall mounted items, such as electrical boxes, switches and the like. This will save installation time for all tradesmen who are in direct contact with the invention. It will allow contractors to visually inspect details such as receptacle heights, switch heights, sconce heights, plumbing drain lines for proper pitch, and cabinet blocking to name a few without the assistance of other tools.

Figure 11:
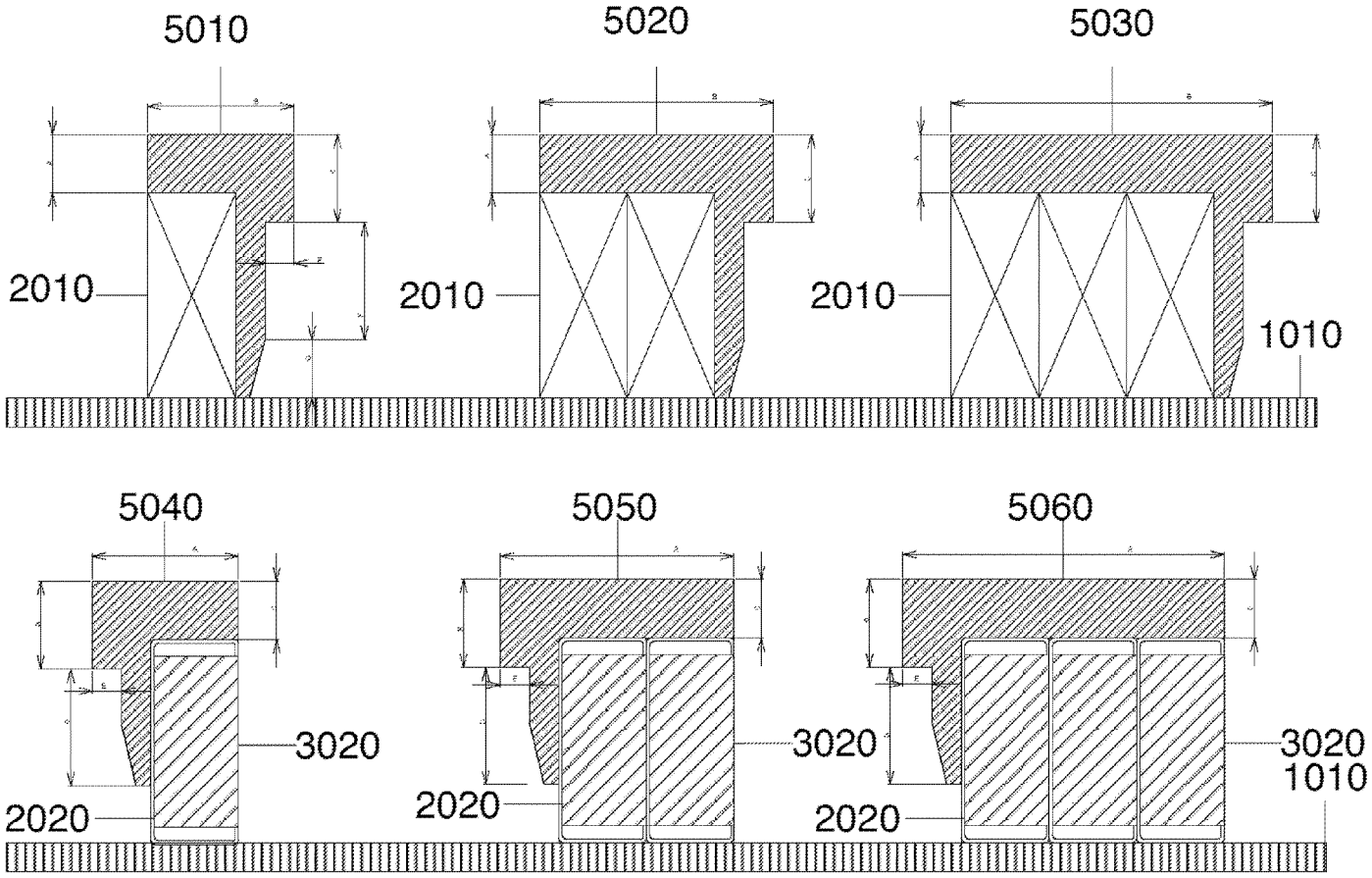
FIG. 11 shows a top cross-section view of a portion of an insulation cap covering various arrangement of wood and steel framing members according to the present invention.
Figure 12:
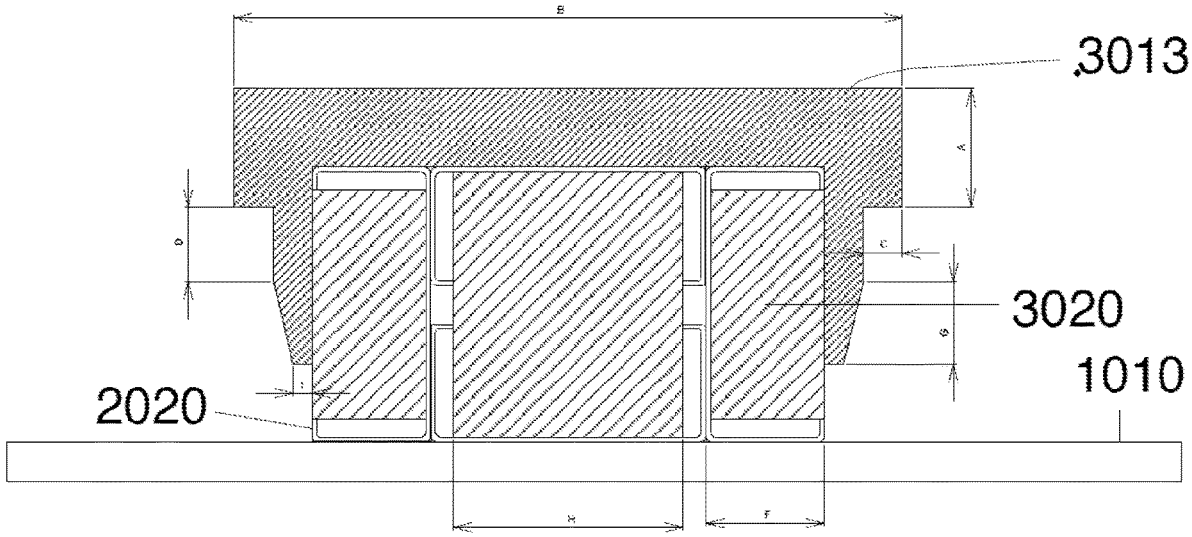
FIG. 12 shows a top cross-section view of an insulation cap covering multiple steel framing members with insulated filler according to the present invention.

FIGS. 11 and 12 show examples of how the insulation cap 5010, 5020, 5030, 5040, 5050, and 5060 can be modified along the "B"/"A" dimension (best shown in FIG. 12, insulation cap 3013 extended along dimension "B") to fit partitions, loadbearing stud columns. FIG. 13 is a perspective view of a window opening in a stud wall. It demonstrates how the different profiles work together to create an airtight configuration.

Figure 15:
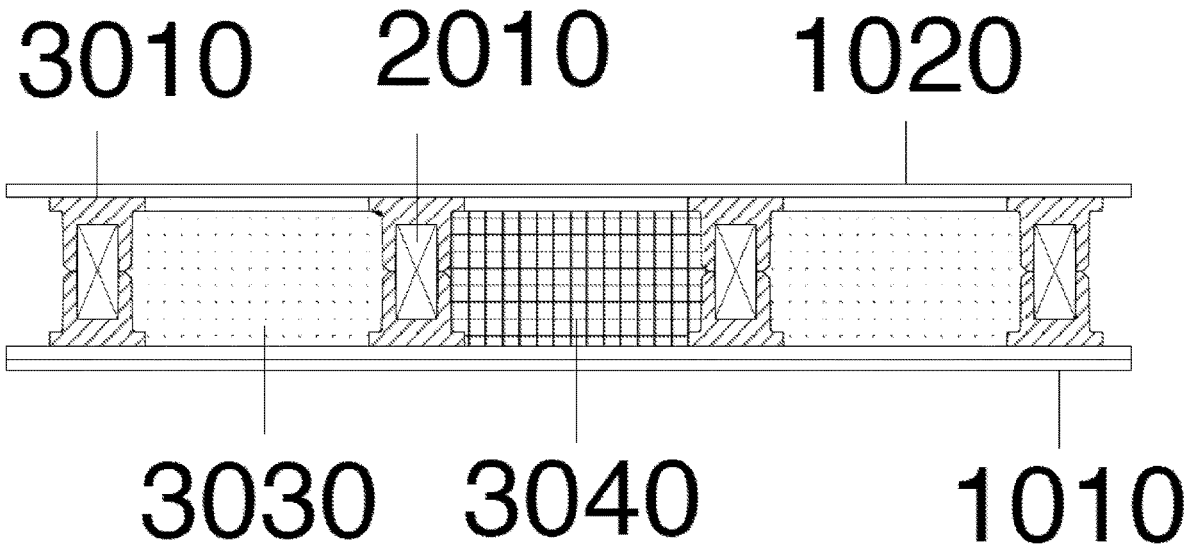
FIG. 15 shows a top plan cross-section view of an insulated wood framed wall with the insulation caps covering frame members according to the present invention; and, FIG. 16 shows a perspective view of an interior side of a wall structure having insulation caps covering frame members according to the present invention.

Referring to FIG. 15, in a further advantageous embodiment, a first insulation cap 3010 is disposed on framing member 2010 between interior sheathing 1020 and framing member 2010, and a second insulation cap is disposed on framing member 2010 between exterior sheathing 1010 and framing member 2010 opposite the first insulation cap so that the framing member is fully encases on all sides with insulation caps.

Figure 16:
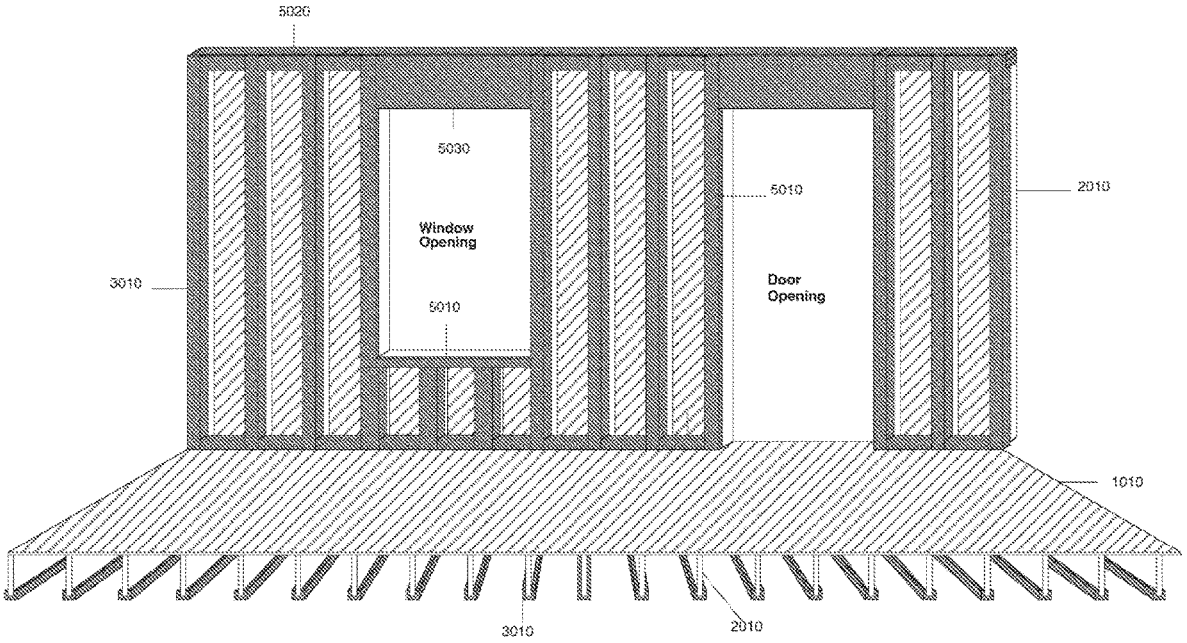

FIG. 16 demonstrates a complete system using the insulation caps to cover all framing members of an exterior wall and how the different sizes of insulation caps as shown in FIG. 11 work together on a wall.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. An insulation system for wall framing member, comprising:

a wall structure having a plurality of framing members with an exterior sheathing disposed on an exterior facing side and an interior sheathing disposed on an interior facing side;

an insulation cap carried by at least one of said framing members;

said insulation cap including a base section with a first side wall extending outwardly from said base section, and a second side wall laterally spaced from said first side wall and extending outwardly from said base section complementary to said first side wall, wherein said base section, said first side wall and said second side wall define a generally U-shaped channel, and wherein said at least one framing member is received into said U-shaped channel so that at least a majority of an exterior surface of said at least one framing member is encased by said insulation cap;

a first shoulder portion disposed on a first end portion of said base section, and a second shoulder portion dispose on a second end portion of said base section opposite said first shoulder portion, wherein said first shoulder portion extends laterally outward perpendicular to said first side wall so that said first side wall and said first shoulder portion define a first retention ledge, and wherein said second shoulder portion extends laterally outward perpendicular to said second side wall so that said second side wall and said second shoulder portion define a second retention ledge;

wherein said framing members comprise metal studs having a generally C-shaped channel carrying an insulation block in said C-shaped channel, and wherein at least one of said first and second side walls of said insulation cap extend adjacent said insulation block to secure said insulation block in said C-shaped channel; and, an insulation material disposed between said framing members, wherein said insulation material engages and is at least partially retained between said framing members by at least one of said first and second retention ledges;

whereby said insulation cap provides a thermal break between said exterior sheathing and said interior sheathing around said framing members and provides an airtight arrangement with said insulation material between said framing members for improved R values.

2. The insulation system of claim 1 wherein said insulation cap includes measurement markings on said base section defining a graduated scale.

3. The insulation system of claim 1 wherein said insulation cap includes securing member markings on said first and second side walls indicating preferred locations for inserting a securing member through said first and second side walls, respectively, to secure said insulation cap to an interior facing side surface of said at least one framing member.

4. The insulation system of claim 1 wherein said insulation material is selected from the group consisting of fiberglass batt insulation and spray foam insulation.

5. The insulation system of claim 4 wherein said retention ledge operates as a depth gauge when said insulation material is spray foam insulation.

6. The insulation system of claim 4 wherein said insulation cap is carried on adjacent framing members with a fiberglass batt insulation disposed between framing members engaging said first retention ledges on a first said insulation cap and engaging said second retention ledge on a second insulation cap of the adjacent framing member for securing said fiberglass batt between said framing members.

7. The insulation system of claim 1 wherein said first and second side walls of said insulation cap extend along the length of an interior facing side surface of said at least one framing member and abut said exterior sheathing so that said insulation cap fully encases three sides of said framing member.

8. The insulation system of claim 1 wherein said first and second side walls extend along a portion of an interior facing side surface of said at least one framing member and define an expansion gap between a distal end of said first and second side walls and said exterior sheathing along an exposed remainder of said interior facing side surface for accommodating expansion of said insulation material.

9. The insulation system of claim 1 wherein said first and second side walls include a tapered end portion providing a recess area for accommodating expansion of said insulation material.

10. The insulation system of claim 1 wherein said insulation cap is comprised of about 2-10 pound poured polyurethane foam and provides structural support to said wall structure.

11. The insulation system of claim 1 wherein said first and second shoulder portions extend at right angles to said first side wall and second side wall, respectively, to define said retention ledges.

12. The insulation system of claim 1 wherein said U-shaped channel of said insulation cap is defined in part by a recess into said base section between said first side wall and said second side wall relative to said first and second retention ledges so that a front surface of said at least one framing member is received into said recess in said base section.

13. The insulation system of claim 1 wherein a first insulation cap is disposed on said framing member between said interior sheathing and said framing member, and a second insulation cap is disposed on said framing member between said exterior sheathing and said framing member opposite said first insulation cap.

14. An insulation cap for wall framing members, comprising:

a base section;

a first side wall extending outwardly from said base section;

a second side wall laterally spaced from said first side wall and extending outwardly from said base section complementary to said first side wall;

a generally U-shaped channel defined by said base section, said first side wall and said second side wall for receiving a framing member;

wherein said first and second side walls are constructed and arranged to extend along a portion of an interior facing side surface when mounted to the framing member and define an expansion gap along an exposed remainder of said interior facing side surface between a distal end of said first and second side walls and an exterior sheathing mounted to the framing member for accommodating expansion of insulation material disposed between framing members;

a first shoulder portion disposed on a first end portion of said base section;

a second shoulder portion dispose on a second end portion of said base section opposite said first shoulder portion;

wherein said first shoulder portion extends laterally outward perpendicular to said first side wall so that said first side wall and said first shoulder portion define a first retention ledge; and, wherein said second shoulder portion extends laterally outward perpendicular to said second side wall so that said second side wall and said second shoulder portion define a second retention ledge.

15. The insulation cap of claim 14 including measurement markings on said base section defining a graduated scale.

16. The insulation cap of claim 14 including securing member markings on said first and second side walls indicating preferred locations for inserting a securing member through said first and second side walls, respectively, to secure said insulation cap to an interior facing side surface of the framing member.

17. The insulation cap of claim 14 wherein said first and second side walls include a tapered end portion providing a recess area for accommodating expansion of said insulation material.

18. An insulation cap for wall framing members, comprising:

a base section;

a first side wall extending outwardly from said base section;

a second side wall laterally spaced from said first side wall and extending outwardly from said base section complementary to said first side wall;

a generally U-shaped channel defined by said base section, said first side wall and said second side wall for receiving a framing member;

wherein said first and second side walls are constructed and arranged to extend along a portion of an interior facing side surface when mounted to the framing member and define an expansion gap along an exposed remainder of said interior facing side surface between a distal end of said first and second side walls and an exterior sheathing mounted to the framing member for accommodating expansion of insulation material disposed between framing members;

a tapered end portion included on each of said first and second side walls defining a recess area for accommodating expansion of insulation material;

a first shoulder portion disposed on a first end portion of said base section;

a second shoulder portion dispose on a second end portion of said base section opposite said first shoulder portion;

wherein said first shoulder portion extends laterally outward perpendicular to said first side wall so that said first side wall and said first shoulder portion define a first retention ledge; and, wherein said second shoulder portion extends laterally outward perpendicular to said second side wall so that said second side wall and said second shoulder portion define a second retention ledge.

* * * * *